United States Patent [19]

Weatherup

[11] Patent Number: 4,954,748

[45] Date of Patent: Sep. 4, 1990

[54] THYRATRON GAS DISCHARGE DEVICE WITH MAGNETIC FIELD FOR IMPROVED IONIZATION

[75] Inventor: Clifford R. Weatherup, Chelmsford, United Kingdom

[73] Assignee: EEV Limited, Chelmsford, United Kingdom

[21] Appl. No.: 278,892

[22] Filed: Dec. 2, 1988

[30] Foreign Application Priority Data

Dec. 5, 1987 [GB] United Kingdom ..... 8728503

[51] Int. Cl.[5] ..... H01J 17/14

[52] U.S. Cl. ..... 313/153; 313/154; 313/155; 313/160; 313/589

[58] Field of Search ..... 313/153, 155, 156, 158, 313/159, 157, 160, 161, 162, 589, 154

[56] References Cited

U.S. PATENT DOCUMENTS

| | | | |
|---|---|---|---|
| 3,435,287 | 3/1969 | Jacobsen | 315/110 |
| 4,071,801 | 1/1978 | Harvey . | |
| 4,307,317 | 12/1981 | Harvey | 313/154 |

FOREIGN PATENT DOCUMENTS

| | | |
|---|---|---|
| 0004962 | 4/1979 | European Pat. Off. . |
| 855395 | 5/1940 | France . |
| 207800 | 2/1925 | United Kingdom . |
| 447947 | 5/1936 | United Kingdom . |
| 675766 | 7/1952 | United Kingdom . |
| 825793 | 12/1959 | United Kingdom . |
| 995018 | 6/1965 | United Kingdom . |
| 1013016 | 12/1965 | United Kingdom . |
| 1257939 | 12/1971 | United Kingdom . |
| 1287091 | 8/1972 | United Kingdom . |
| 1593634 | 1/1978 | United Kingdom . |
| 2088122 | 6/1982 | United Kingdom . |
| WO8505489 | 12/1985 | PCT Int'l Appl. . |

*Primary Examiner*—Kenneth Wieder
*Attorney, Agent, or Firm*—Spencer & Frank

[57] ABSTRACT

In a thyratron gas discharge device, magnetic material is located coaxially with the anode to produce a magnetic field between the anode and cathode which is substantially parallel to a discharge established between them. This causes electrons emitted from the cathode to have longer path lengths than would otherwise be the case and so the ionization density within the device is increased. This improved this operating characteristics of the thyratron and results in greater utilization of the cathode.

19 Claims, 2 Drawing Sheets

THYRATRON GAS DISCHARGE DEVICE WITH MAGNETIC FIELD FOR IMPROVED IONIZATION

BACKGROUND OF THE INVENTION

This invention relates to gas discharge devices and particularly, but not exclusively, to thyratrons.

A thyratron generally comprises an anode, a cathode, and an intervening grid structure contained within an envelope filled with gas. When it is wished to establish conduction through the device, a discharge is produced within the thyratron by applying a suitable potential to a control grid.

SUMMARY OF THE INVENTION

The present invention seeks to provide improved gas discharge devices.

According to the invention, there is provided a gas discharge device comprising an anode, a cathode and means arranged to produce a magnetic field within the device such that charged particles of a discharge have a longer path length than they would in the absence of the field whereby the amount of ionisation within the device is increased. Charged particles which travel parallel to magnetic field lines experience zero force. Those which do not move parallel to the field lines experience a force which is perpendicular to the direction of travel and the magnetic field lines. This results in the particles following a curved path about the field lines. Thus electrons emitted from the cathode in a non-parallel direction to the magnetic field travel along a helical path as they move towards the anode. They therefore have a longer path length when the magnetic field is present than would otherwise be the case. This increases the number of collisions which occur and hence the ionisation density within the device. A gas discharge device in accordance with the invention thus enables greater ionisation density to be achieved than would be obtained in a conventional device. This may result in an improved rate of voltage fall after triggering, a reduction in the triggering energy required and an improved cathode life. Also, it has been found that a more uniform ionisation in the cathode region is produced, the ionisation extending into regions which were previously unused in the absence of a magnetic field.

It is preferred that the magnetic field is arranged to be present during switching when a current is passing between the anode and cathode. That is, the magnetic field exists during conduction of a pulse through the device. Preferably, the magnetic field comprises a component substantially parallel to the direction of a discharge within the device. This is particularly advantageous as the charged particles which travel in a spiral path about the magnetic field component lines tend to be retained within the main discharge region. If the magnetic field had only one component in a direction inclined to the direction of the discharge, the charged particles would tend to be drawn from the discharge region and thus ionised particles would be produced in a less effective location.

Preferably, the means arranged to produce a magnetic field comprises magnetic material, which advantageously is samarium cobalt, although an electro-magnet could be used. In a preferred embodiment of the device, the magnetic material is located at the anode, although it could, for example, be located coaxially about the cathode.

The invention may be particularly advantageously applied where the device is a thyratron. At least part of the grid structure may be included in a magnetic circuit forming part of the means arranged to produce the magnetic field.

BRIEF DESCRIPTION OF THE DRAWINGS

Some ways in which the invention may be performed are now described by way of example with reference to the accompanying drawings in which.

DESCRIPTION OF PREFERRED EMBODIMENTS

Figure 1:
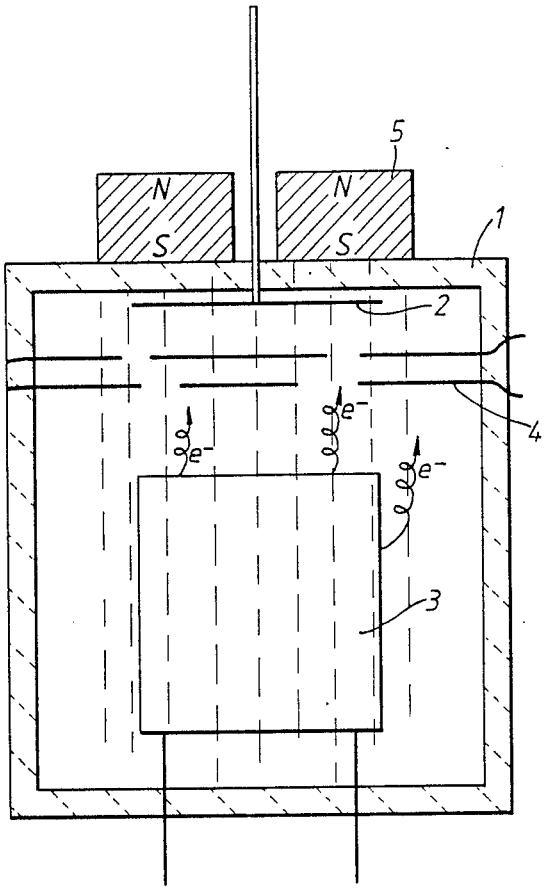
FIG. 1 is a schematic diagram of a gas discharge device in accordance with the invention.

With reference to FIG. 1, a thyratron comprises a ceramic envelope 1 within which is contained an anode 2, a thermionic cathode 3 and a grid structure 4 located between them. Hydrogen at a pressure of a few torr is also contained within the envelope 1. A cylindrical samarium cobalt magnet 5 is located coaxially about the anode stem outside the envelope 1. The part of the magnet nearest the cathode is a south pole and the other end a north pole. The magnetic field produced within the thyratron by the magnet 5 is substantially parallel to the direction normal to the cathode and anode surfaces as indicated by the broken lines, which represent magnetic field lines. During operation of the thyratron, electrons are emitted from the cathode 3. Those which do not travel in a direction parallel to the magnetic field follow helical paths about the field lines and are drawn towards the grid by the electric field applied to it. Each electron travelling along a spiral path has the opportunity to make any more ionizing collisions as it moves towards the grid 4 and anode 2 than would be the case if it moved in a substantially direct path to the anode 2, which would happen if the magnetic field were absent. It has been observed tht the region of intense glow usually situated at one side of a cathode structure in a conventional thyratron is spread around the cathode fairly uniformly in a thyratron in accordance with the invention, indicating improved utilisation of the cathode 3.

Figure 2:
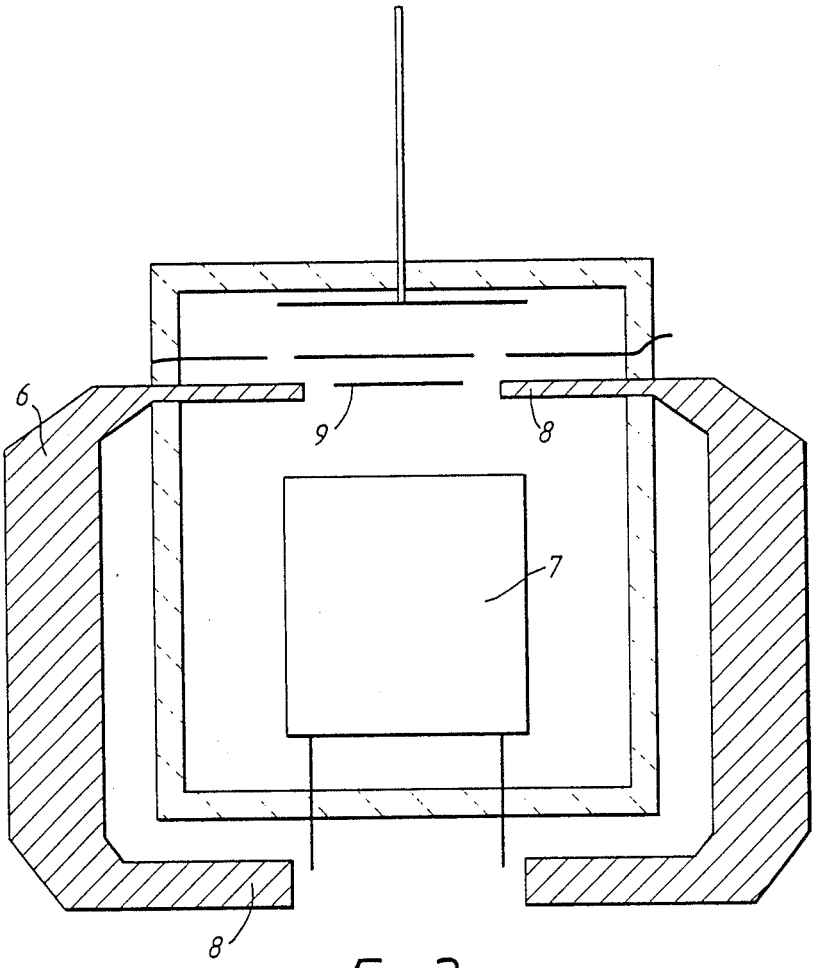
FIG. 2 is a schematic diagram of another device in accordance with the invention.

With reference to FIG. 2, another thyratron in accordance with the invention is similar to that shown in FIG. 1, but includes magnetic material 6 located coaxially about the cathode 7 and having pole pieces 8, part of the magnetic circuit being formed by the grid structure 9.

I claim:

1. In a thyratron gas discharge device including an anode, a cathode and a grid structure located between said anode and said cathode; the improvement comprising means arranged to produce a magnetic field within the device such that charged particles of a discharge between said anode and said cathode have a longer path length than they would in the absence of the magnetic field whereby the amount of ionisation within the device is increased.

2. A device as claimed in claim 1 wherein the magnetic field is arranged to be present during switching when a current is passing between the anode and the cathode.

3. A device as claimed in claim 1 wherein the magnetic field comprises a component substantially parallel to the direction of a discharge within the device.

4. A device as claimed in claim 1 wherein the means arranged to produce a magnetic field comprises magnetic material.

5. A device as claimed in claim 4 wherein the magnetic material is samarium cobalt.

6. A device as claimed in claim 4 wherein the magnetic material is located at the anode.

7. A device as claimed in claim 1 wherein at least part of the grid structure is included in a magnetic circuit of said magnetic field producing means.

8. A device as claimed in claim 1 wherein the means arranged to produce a magnetic field includes at least part of an electrode structure.

9. A device as claimed in claim 3 wherein said means arranged to produce a magnetic field includes a cylindrical magnet located coaxially with and adjacent said anode.

10. A device as defined in claim 3 wherein said means arranged to produce a magnetic field includes magnetic material coaxially surrounding said cathode and provided with inwardly radially extending pole pieces at its respective ends; and one of said pole pieces is formed, at least in part, by part of said grid structure.

11. A device as claimed in claim 3 wherein said means arranged to produce a magnetic field produces a stationary magnetic field.

12. A thyratron comprising: a gas containing envelope; spaced anode and cathode electrodes displosed in said envelope; a grid structure disposed within said envelope in a discharge space between said anode and cathode electrodes; and means for producing within said envelope, a magnetic field having a component extending substantially parallel to the gas discharge direction within said discharge space between said anode and said cathode electrodes, whereby charged particles which do not travel parallel to said magnetic field component in a discharge between said anode and cathode electrodes are caused to follow a longer travel path between said anode and cathode electrodes.

13. A thyratron as defined in claim 12 wherein said means for producing a magnetic field produces a stationary magnetic field.

14. A thyratron as defined in claim 12 wherein said means for producing a magnetic field comprises a permanent magnet.

15. A thyratron as defined in claim 14 wherein said permanent magnet is a cylindrical magnet disposed coaxially with and adjacent said anode electrode.

16. A thyratron as defined in claim 15 wherein the end of said magnet facing said cathode is a south pole.

17. A thyratron as defined in claim 15 wherein said means for producing a magnetic field includes a magnetic circuit formed at least in part by magnetic material which coaxially surrounds said cathode electrode.

18. A thyratron as defined in claim 17 wherein said magnetic circuit includes a part of said grid structure.

19. A thyratron as defined in claim 18 wherein at least a portion of said magnetic circuit is disposed outside of said envelope.

* * * * *